US006260196B1

(12) United States Patent
van der Sleesen

(10) Patent No.: US 6,260,196 B1
(45) Date of Patent: Jul. 17, 2001

(54) PROTECTIVE GARMENTS WITH FLOATING ARMOR SYSTEM

(75) Inventor: Michael F. van der Sleesen, Lakeville, MA (US)

(73) Assignee: Vanson Leathers, Inc., Fall River, MA (US)

( * ) Notice: Subject to any disclaimer, the term of this patent is extended or adjusted under 35 U.S.C. 154(b) by 0 days.

(21) Appl. No.: 09/393,961

(22) Filed: Sep. 10, 1999

Related U.S. Application Data

(63) Continuation-in-part of application No. 09/156,917, filed on Sep. 18, 1998, now Pat. No. 6,070,274.

(51) Int. Cl.[7] ..... A41D 13/00
(52) U.S. Cl. ..... 2/2.5; 2/455
(58) Field of Search ..... 2/455, 456, 459, 2/46 B, 467, 2.5, 16

(56) References Cited

U.S. PATENT DOCUMENTS 930,741 * 8/1909 Dean ..... 2/2.5
1,290,799 * 1/1919 Talley ..... 2/2.5
1,669,085 * 5/1928 Guyon ..... 2/2.5
5,507,042 4/1996 van der Sleesen ..... 2/69
5,652,967 * 8/1997 Hsu ..... 2/463
5,704,064 1/1998 van der Sleesen ..... 2/69
5,729,832 * 3/1998 Grilliot et al. ..... 2/2.5
5,752,277 5/1998 van der Sleesen ..... 2/69

* cited by examiner

*Primary Examiner*—Bibhu Mohanty
(74) *Attorney, Agent, or Firm*—McDermott, Will & Emery

(57) ABSTRACT

A protective garment for use when riding motorcycles or other vehicles in which the rider is exposed includes protective armor in, for example, portions of the garment covering the back, shoulders, elbows and knees. The armor is attached elastically to the interior of the garment so that it can move freely with the rider instead of being immovably fixed to garment. The armor thus protects the rider's most vulnerable areas from abrasion or impact, regardless of the rider's movements in the garment, and does not restrict the rider's movements or compromise his comfort while in the garment.

9 Claims, 3 Drawing Sheets

PROTECTIVE GARMENTS WITH FLOATING ARMOR SYSTEM

CROSS-REFERENCE TO RELATED APPLICATIONS

This application is a continuation-in-part of U.S. application Ser. No. 09/156,917, filed on Sep. 18, 1998 now U.S. Pat. No. 6,070,274.

FIELD OF THE INVENTION

The present invention relates to protective garments designed for use by, for example, motorcycle riders.

BACKGROUND OF THE INVENTION

Materials for the protective garments worn by motorcycle riders should be durable and rugged, yet relatively flexible and lightweight, aerodynamic, and aesthetically appealing. In addition, they should be controllably vented to provide adjustable airflow into and through the garment for cooling on hot days.

U.S. Pat. Nos. 5,704,064, 5,507,042, 5,752,277 and 5,596,769, all issued to van der Sleesen and assigned to the assignee of the present invention, disclose representative protective garments for motorcycle riders.

Although such garments are preferably made of a durable material, such as leather, additional protection may be conferred to the rider by including protective armor or shielding in portions of the garments which cover vulnerable areas of the rider's body, such as, for example, the elbows, knees, shoulders, ribs, stomach, and lower back. In the prior art, such protective armor is typically a solid, rigid piece which is fixedly attached to the inside or outside of the garment in the desired locations. The armor may be removable from the garment, but when attached to the garment, it is fixedly attached.

Motorcycle riding is an active sport, as the rider is constantly changing his position as he corners, brakes, accelerates and optimally controls the bike. Such constant movement should be permitted without restrictions or discomfort of any kind. Some discomfort and restrictions may be introduced by the use of armored protective garments, and any such discomfort or restricted movements are clearly undesirable. The discomfort and restrictions typically result from the fixation of armor and/or pads in the garment at vulnerable points, such as the elbows and knees. Any restrictions or discomfort are fatiguing and distracting and therefore should be avoided so as to enhance rider performance and safety.

In early days of motorcycle riding, before protective armor was used, a rider wearing a protective garment such as a leather suit could suffer repeated falls from the bike without ruining the garment. As speeds increased, the use of hard armor in protective garments became desirable to spread the impact of a fall over a larger area. However, the damage to the protective garments also increased significantly, because the hard armor elements would push the outer panel of the garment into the pavement or impact surface, and the outer panel would be ground away between the two unforgiving surfaces.

It would therefore be advantageous to provide a protective garment for motorcycle riders which is overcomes the deficiencies of garments known in the art.

SUMMARY OF THE INVENTION

Although safety and protection are primary objectives of the garments of the type worn by motorcyclists, comfort is critical to the success of the garment, because if it is not comfortable to wear and move in, the rider will not wear it, and no safety benefits will be attained. Accordingly, the present invention provides a protective garment having protective armor which is elastically attached to the inside of the garment and which moves with and protects the rider without restricting his or her movements in the garment. As a result, the rider is more comfortable in the garment and is more likely to wear it, thereby increasing his or her protection and safety. Rider comfort is of paramount importance, particularly in garments worn for competitive riding, such as, for example, racing suits. Any discomfort is both fatiguing and distracting to the rider, and therefore potentially dangerous.

Another feature provided by the invention is an improvement to the construction of garments which include protective armor elements, so that the hard armor element is protected within the garment. This reduces the tendency of the outer material of the garment to be worn away between the armor and the impact surface in a fall and prolongs garment life.

According to one aspect of the invention, the protective garment comprises a plurality of outer panels covering one or more of a rider's torso, back, arms and legs, and one or more armor elements elastically attached to an interior surface of one or more of the outer panels at preselected locations. The armor element is movable relative to a corresponding outer panel in response to the rider's movements inside the garment.

In a preferred embodiment, the armor element may additionally be attached to one or more resilient pads. One or more pads may be located between the armor element and the rider, for greater rider protection and comfort. Additional pads may be located between the armor element and the outer panel of the garment for greater protection of the garment outer panel.

The garment can further include a seating element which is removably attached to the armor element. The seating element is adapted to be seatedly centered around portions of the wearer's body to be protected, such as, for example, the wearer's knees, elbows and collarbone/shoulder areas.

The armor element may be either permanently or removably attached to the interior face of the outer panel.

In one embodiment, the garment may include one or more substantially inelastic fasteners for attaching the armor element to the interior surface of the outer panel.

The armor element moves relative to a corresponding outer panel substantially in the direction of a principal axis or plane of the outer panel.

The garment can include venting for increased versatility and comfort.

These and other objects and advantages of the invention will in part be obvious and will in part appear hereinafter. The invention accordingly comprises the apparatus possessing the construction, combination of elements and arrangement of parts which are exemplified in the following detailed disclosure, the scope of which will be indicated in the claims.

BRIEF DESCRIPTION OF THE DRAWINGS

For a fuller understanding of the nature and objects of the present invention, reference should be had to the following detailed description taken in connection with the accompanying drawings, in which.

Like elements in the FIGURES are indicated by like reference numerals.

DETAILED DESCRIPTION OF THE DRAWINGS

Figure 1:
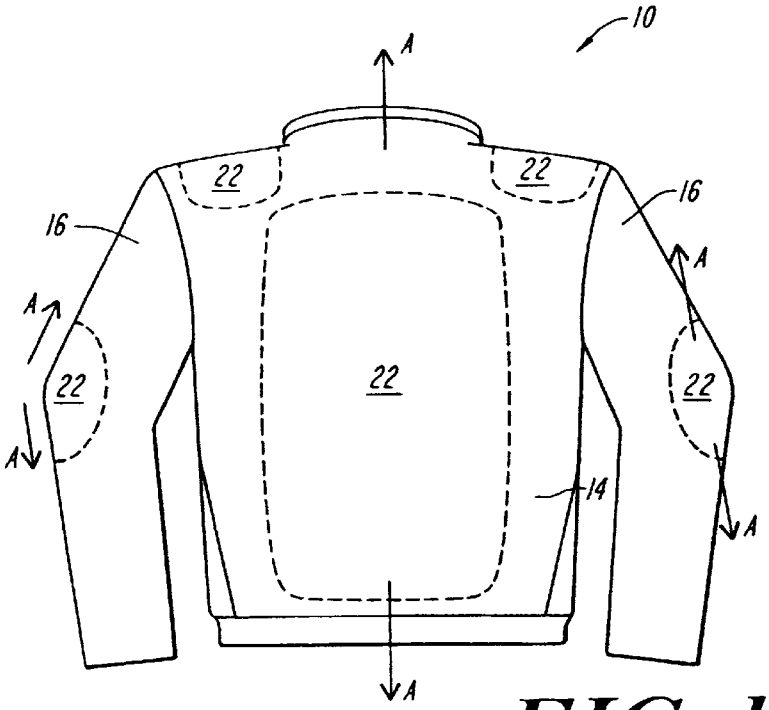
FIG. 1 is a rear view of a protective garment in the form of a jacket having protective armor elements in the back, elbows, and shoulder and collarbone areas according to one aspect of the invention.
Figure 2:
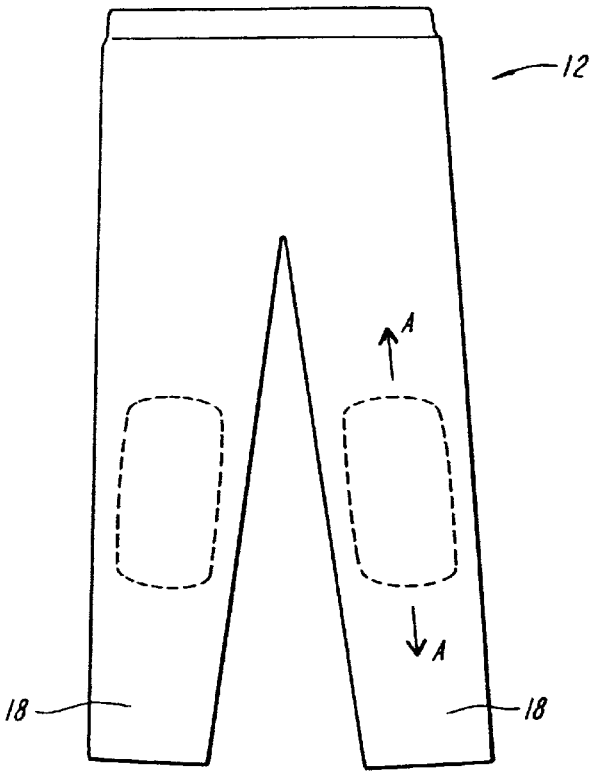
FIG. 2 is a front view of a protective garment in the form of pants having protective armor elements in the knees.

Protective garments according to one aspect of the invention are shown in FIGS. 1 (illustrated as a jacket 10) and 2 (illustrated as pants 12). The jacket 10 of FIG. 1 includes a rear outer panel 14 and sleeves 16. The rear panel 14 of the jacket includes protective armor which extends over a substantial area of the rear panel. The pants 12 of FIG. 2 includes legs 18. Protective armor is preferably located in areas of greatest exposure and/or vulnerability to injury, such as the rear panel, and over the joints at the shoulder and collarbone areas, the elbows, and the knees.

Figure 3:
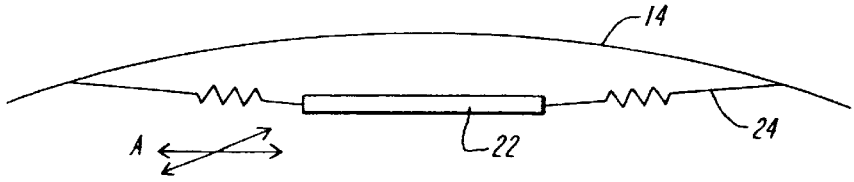
FIG. 3 is a simplified sectional view of a basic form of construction of a protective portion of a garment according to the invention.

FIGS. 3–6 show various details of the construction of the garment. FIG. 3 shows, in schematic form, a basic construction of a protective portion of a garment according to the invention. A protective armor element 22 is elastically attached to the outer panel of the garment 14 by one or more elastic members 24. The elastic member can be elastic tape or banding and is attached to peripheral points of the armor element. The elastic members 24 give the armor the ability to move with the rider in the directions of arrows A, instead of being fixed to the garment.

Figure 4:
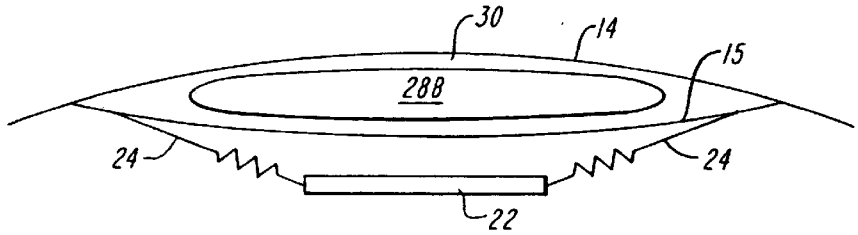
FIG. 4 is a simplified sectional view of an alternate form of construction of a protective portion of a garment according to the invention.

FIG. 4 illustrates another embodiment of the basic construction. Here, the armor element 22 is sandwiched between a pad 28A on its inner side, nearest the rider, and a pad 28B on its outer side, just inside the outer panel 14 of the garment. The pad 28B may be itself sewn into a pocket 30 formed inside the garment with a complementary interior panel 15, which may be made of a similar material to that of the outer panel 14. The armor element 22 is attached, such as with stitching 29, to the pad 28A.

Figure 5:
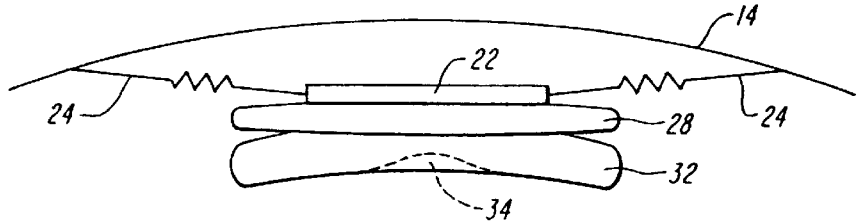
FIG. 5 is a simplified sectional view of another form of construction of a portion of a protective garment according to the invention.
Figure 6:
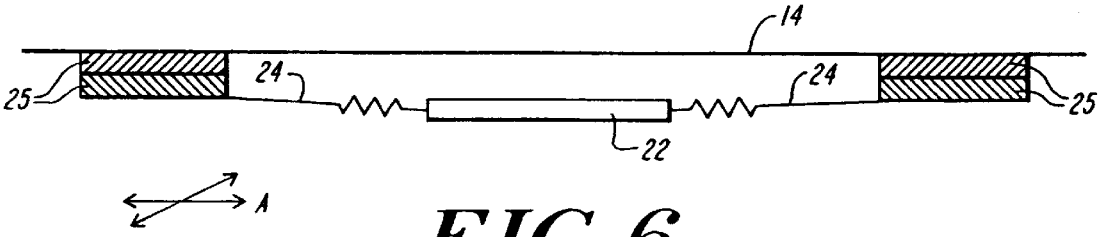
FIG. 6 is a simplified detail sectional view of a form of attachment of the armor element to the garment.

As shown in FIG. 5, additional padding in the form of a seating element 32 may be located closest to the wearer to provide additional protection, padding and centering for an elbow, knee or shoulder. The seating element 32 may be contoured to conform to the portion of the anatomy being protected and is preferably removably attached to the armor element 22 by means of, for example, removable fasteners such as a hook and loop strip, snaps or the like. The seating element 32 is preferably disposed closest to the wearer and helps guide the joint to an optimally protected portion of the garment. As shown in FIG. 5, the seating element 32 may include a recess 34 which is shaped to fit around a wearer's elbow, shoulder/collarbone area or knee, thereby centering the joints in the protective portions of the garment. The seating element 32 is preferably adjustably positionable in the garment via fasteners to provide adjustable fit and centering of the armor around the joints or portions of the body to be protected.

The armor 22 can be attached to the garment panel 14 directly with elastic members 24, or indirectly with another relatively non-elastic fastener, such as a hook and loop strip. This is illustrated schematically in FIG. 6. Here, the armor element 22 is attached to an elastic member 24, which is attached to a hook and loop fastener strip 25 which engages with a corresponding strip attached to the garment panel 14. The elastic member 24 still allows the armor element to move with the rider instead of with the garment, as indicated by arrows A.

The resilient pad 28A may be contoured to a specific portion of the wearer's anatomy, as required by the intended location of the armor in the garment.

The armor element 22 may be a contoured plate or a thicker, puck-shaped body, as needed for protection of a particular anatomical feature.

Figure 7:
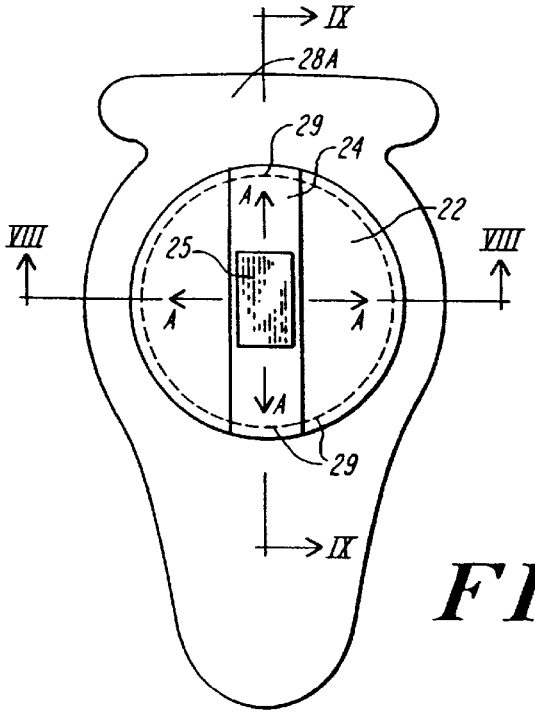
FIG. 7 is a plan view of an alternate construction of a portion of a protective garment according to the invention.

FIG. 7 illustrates an alternate construction of the garment. Protective armor element 22 is affixed, such as with stitching or adhesive, to a pad 28A, which may be in contact with the rider inside the garment, as described above. An elastic member 24 may be affixed directly to the armor element 24, such as with stitching 29, at peripheral points on the armor element 22. Hook and loop fastener 25 may be attached to the elastic member 24 and to a corresponding location on the inside face of the outer panel 14. The elastic member 24 is free to stretch and slide over the crown of the armor element in the directions of arrows A in FIG. 7. Thus, while the hook and loop fastener strips are engaged, the armor and its associated pad can move as allowed by the elastic member as the rider moves.

Figure 8:
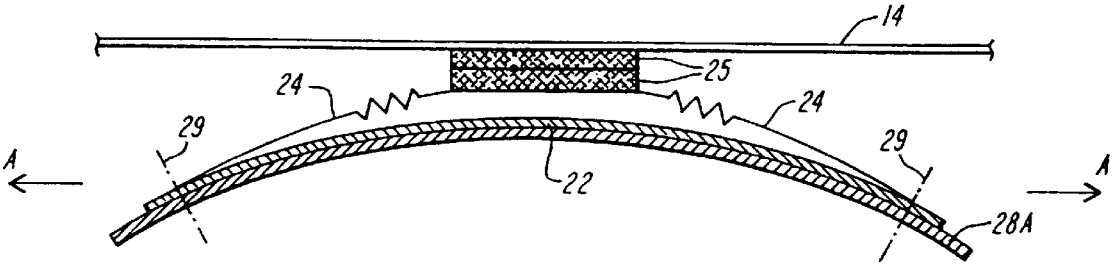
FIG. 8 is a sectional view of the construction of FIG. 7, taken along section lines VIII—VIII.
Figure 9:
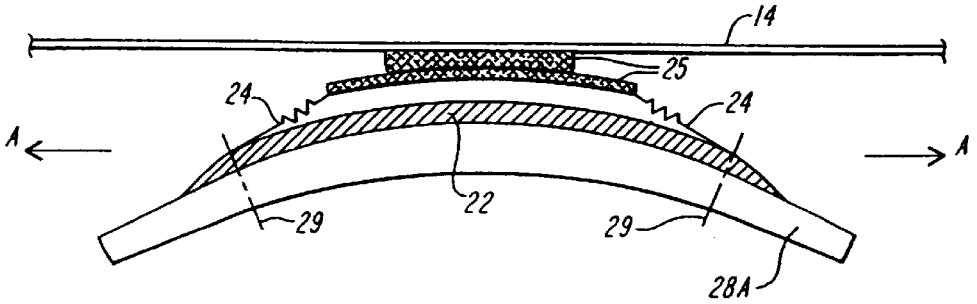
FIG. 9 is a sectional view of the construction of FIG. 7, taken along section lines IX—IX.

FIGS. 8 and 9 are sectional views along section lines VIII—VIII and IX—IX, respectively. These FIGURES show that the armor element 22 and pad 28A may be contoured to conform to a particular anatomical feature, such as an elbow or knee and also show the direction of movement or "float" of the armor element 22 by means of elastic members 24. Hook and loop fasteners 25 attach the elastic members to the garment panel 14.

As an example, if a rider is wearing pants with protective armor and either sits or crouches in a riding position, the pants may typically ride up the leg. If the armor element is fixed in the pants leg at an appropriate spot, nominally at the knee, so that the rider can comfortably stand up, the act of sitting or crouching would pull the armor element up too high and locate it in the wrong spot for protecting the knee, or at the very least locate it so that it is uncomfortably placed. The garment construction of the present invention allows the armor element to remain in the desired position regardless of the rider's movements in the garment.

This construction allows the armor element 22 and associated pad 28 the ability to "float" in the garment and therefore move with the rider instead of with the garment.

The elastic attachment of the protective shield member 22 in the garment shown in FIG. 1 at the shoulders of the garment prevents the neckline of the garment from being pulled down uncomfortably at the center back of the garment.

The protective armor elements 22 may be located at regions of particular vulnerability on the rider's body, such as, for example, over the elbows, knees, shoulders, collarbones, lower back, floating ribs, stomach or other areas of the body. They may be permanently or removably attached to the interior face of one or more outer panels of the garment, such as by being sewn in or fastened with hook and loop fasteners.

The armor element is preferably made of a durable, lightweight polymeric material, such as polypropylene. The pads 28 are preferably made of a lightweight, yet durable, foam padding or the like. A preferred material for the outer and interior panels is, for example, leather or Cordura®.

The inventive concepts described herein are applicable to any type of garment, including, for example, vests, gloves, and full-body suits.

Because the protective armor elements are mounted elastically to the inside of the garment at various locations, they are free to move or float relative to the outer panels, sleeves or legs of the garment and thus define an active protection system for the wearer which moves with him as he moves in the garment. Thus, if the rider takes a spill and the garment drags along the ground, the armor elements inside the garment are not constrained to move with the garment, but are instead free to move with the wearer's body inside the garment and can be located in positions which afford greater protection for the wearer in a fall. The force of impact and/or sliding against the contact surface does not pull or rotate the armor away from its intended position over the rider's vulnerable areas. This is especially important, as often in a fall the sleeve of a garment may rotate and could pull conventional armor with it, thus exposing the rider's elbow to injury. With the floating armor system of the present invention, the armor elements can move as needed to remain in contact with the portions of the rider's body that may require protection from the impact surface. The protective armor system of the present invention is thus an active protection system and moves as one with the wearer instead of remaining a stationary, restrictive and passive part of the garment.

The garment may include one or more vent openings for admitting air into and out of the garment. The vent openings are preferably spanned by an air-permeable material, such as a mesh or otherwise perforated material which admits air into and out of the garment. In one preferred embodiment, the air-permeable material is substantially non-stretchable and therefore provides structure to the garment without changing the fit. A preferred non-stretchable, air-permeable material is perforated leather, but other suitable materials are within the scope of the invention. Preferably, the perforations are relatively small compared to the interperforation spacing. In other forms of the invention, stretchable air-permeable materials can be used, although such forms permit distortions of the nominal shape of the garment.

The vent openings of the garment may be covered with selectively adjustable air-impermeable vent covers. The vent covers may be located on the outside of the garment or on the inside, depending on the design of the garment and the need for an aerodynamic outer surface. The vent covers are preferably attached to the garment with a closure element, such as a zipper or a hook and loop fastener. The vent covers are adjustably placed over the vent openings to regulate the air flowing into and through the garment, thereby regulating the cooling of the wearer. They may be tucked into an interior or exterior pocket when not covering the vent openings. Alternatively, the vent cover may be entirely removable from the garment. The vent cover may include an interior storage compartment and may be entirely removable from the garment. If removable, the vent cover can also function as a wallet for keys, money and other relatively small objects.

Because certain changes may be made in the above apparatus without departing from the scope of the invention herein disclosed, it is intended that all matter contained in the above description or shown in the accompanying drawings shall be interpreted in an illustrative and not a limiting sense.

I claim:

1. A protective garment, comprising:

a plurality of outer panels covering one or more of a wearer's torso, back, arms and legs; and one or more protective armor elements elastically attached to an interior surface of one or more of the outer panels at preselected locations, wherein the armor element is movable relative to a corresponding outer panel in response to the wearer's movements inside the garment.

2. A protective garment according to claim 1, wherein the armor element is permanently attached to the interior surface of the outer panel.

3. A protective garment according to claim 1, wherein the armor element is removably attached to the interior surface of the outer panel.

4. A protective garment according to claim 3, further including one or more substantially inelastic fasteners for attaching the armor element to the interior surface of the outer panel.

5. A protective garment according to claim 1, further including a substantially resilient pad attached to the armor element between the wearer and the armor element.

6. A protective garment according to claim 5, further including a substantially resilient pad attached to the armor element between the outer panel of the garment and the armor element.

7. A protective garment according to claim 5, further comprising a seating element removably attached to the armor element, wherein the seating element is adapted to be seatedly centered around a portion of the wearer's body.

8. A protective garment according to claim 7, wherein the seating element is contoured to seat at one or more of the group consisting of the wearer's knees, elbows and collarbone/shoulder areas.

9. A protective garment according to claim 1, wherein the armor element is movable substantially along one of a principal plane and a principal axis of a corresponding outer panel.

* * * * *